US005847634A

United States Patent [19]

Korenivski et al.

[11] Patent Number: 5,847,634

[45] Date of Patent: Dec. 8, 1998

[54] ARTICLE COMPRISING AN INDUCTIVE ELEMENT WITH A MAGNETIC THIN FILM

[75] Inventors: Vladislav Korenivski, Stockholm, Sweden; Robert Bruce van Dover, Maplewood, N.J.

[73] Assignee: Lucent Technologies Inc., Murray Hill, N.J.

[21] Appl. No.: 902,686

[22] Filed: Jul. 30, 1997

[51] Int. Cl.[6] ..... H01F 5/00; H01F 27/24; H01F 17/06

[52] U.S. Cl. ..... 336/200; 336/177; 336/234; 336/178

[58] Field of Search ..... 336/175, 177, 336/178, 200, 223, 232, 234

[56] References Cited

U.S. PATENT DOCUMENTS

| | | | |
|---|---|---|---|
| 5,420,558 | 5/1995 | Ito et al. | 336/200 |
| 5,450,755 | 9/1995 | Saito et al. | 336/200 |

FOREIGN PATENT DOCUMENTS

| | | | |
|---|---|---|---|
| 24 09 881 | 9/1975 | Japan | 336/83 |

OTHER PUBLICATIONS

"Characteristics and Analysis of a Thin Film Inductor with Closed Magnetic Circuit Structure", by M. Yamaguchi et al., *IEEE Transactions on Magnetics,* vol. 28, No. 5, Sep. 1992, pp. 3015–3017.

"High Frequency Measurement Technique for Patterned Soft Magnetic Film Permeability with Magnetic Film/Conductor/Magnetic Film Inductance Line", by M. Senda et al., *Review of Scientific Instruments,* vol. 64(4), Apr. 1993, pp. 1034–1037.

"High Frequency Magnetic Properties of $CoFe/SiO_2$ Multilayer Film with the Inverse Magnetostrictive Effect", M. Senda et al., *IEEE Transactions on Magnetics,* vol. 30, 1994, p. 155.

*Primary Examiner*—Michael L. Gellner
*Assistant Examiner*—Anh Mai
*Attorney, Agent, or Firm*—Eugene E. Pacher

[57] ABSTRACT

A thin film inductive element according to this invention comprises an elongate conductor, and spaced apart magnetic strips that substantially surround the conductor, with dielectric material between the magnetic strips and the conductor. The inductive element can have relatively high inductance and low loss, can be used in linear form, meander on spiral form, or any other desired form, is suitable for use at RF frequencies, and can be integrated with conventional circuitry. Criteria for choosing the length of the magnetic strips and the thickness of the dielectric are disclosed.

11 Claims, 1 Drawing Sheet

ARTICLE COMPRISING AN INDUCTIVE ELEMENT WITH A MAGNETIC THIN FILM

FIELD OF THE INVENTION

This invention pertains to thin film inductors, more specifically, to articles that comprise thin film inductors suitable for radio frequency use.

BACKGROUND

Inductors are important constituents of many radio frequency (RF) systems. An important application of inductors is in mobile communication systems. In that and other applications it would be very desirable to be able to form the inductive element, optionally together with another passive component such as a capacitor, on a semiconductor chip that also comprises integrated circuitry. "Real estate" on an IC chip being costly, it clearly is highly desirable for the inductive element to have high inductance/unit area.

It is well known that the inductance of a current-carrying conductor is increased if a high permeability material is disposed near the conductor. Thus, inductive elements that comprise a planar conductor (e.g., a spiral conductor) encased in magnetic material or sandwiched between magnetic material are in the prior art. See, for instance, M. Yamaguchi et al., *IEEE Transactions on Magnetics*, Vol. 28 (5), September 1992, p. 3015.

Sandwiching a spiral conductor between magnetic layers can result in substantially increased inductance. However, the combination still has disadvantages. For instance, it is difficult to bias the magnetic layers to keep them in a single domain state. Furthermore, the large out-of-plane component of the RF field will inevitably induce large in-plane eddy currents in a metallic magnetic film. Still furthermore, in order to obtain significantly increased inductance, the thickness of the magnetic films must be comparable to the lateral dimensions of the spiral, i.e., typically 0.1–1 mm.

In view of the importance of planar inductive elements that have relatively high inductance/unit area, it would be desirable to have available conductors having high self-inductance. Such conductors could be used in any desired configuration, e.g., linear, meander, or spiral. This application discloses such conductors.

M. Senda et al., *Review of Scientific Instruments,* Vol. 64 (4), April 1993, p. 1034, disclose a technique for measuring the permeability of soft magnetic films that involves providing a test sample that comprises an elongate conductor surrounded by spaced-apart "sleeves" of the magnetic material. Exemplarily, the sleeves had length $w_m$ of 50 $\mu$m.

M. Senda et al., *IEEE Transactions on Magnetics*, Vol. 30, 1994, p. 155, report measurements of high frequency magnetic properties of $CoFe/SiO_2$ multilayer films. The sample geometry was substantially as described above. See FIG. 1 of the above reference.

SUMMARY OF THE INVENTION

In a broad aspect the invention is embodied in an article that comprises an inductive element of structure selected to yield improved characteristics, including high inductance/unit length, at an operating frequency $f_o$ in the approximate range 0.1–2 GHz.

More specifically, the invention is embodied in an article (e.g., an IC chip with integrated passive components), that comprises a substrate (e.g., a Si chip) having a major surface with an inductive element thereon, the inductive element comprising an elongate conductor (e.g., a Cu or Al strip), a multiplicity of spaced apart lower magnetic strips (oriented generally such that the length of a given strip is parallel to the axis of the elongate conductor) disposed on the major surface, and a corresponding multiplicity of spaced apart upper magnetic strips (oriented generally as the lower magnetic strips), with the elongate conductor disposed between the upper and lower magnetic strips. The magnetic strips typically but not necessarily have equal length $l_m$.

Significantly, the article further comprises dielectric material disposed between the spaced apart lower magnetic strips and the elongate conductor, and between the elongate conductor and the spaced apart upper magnetic strips. The material of the magnetic strips typically is ferromagnetic or ferrimagnetic, and of relatively low conductivity. The dielectric material that is disposed between the elongate conductor and the magnetic strips prevents low frequency current leakage from the conductor to the magnetic strips. However, at high frequencies, the magnetic strips are capacitatively coupled to the elongate conductor, and displacement current flows in the magnetic strips. The undesirable displacement currents can be minimized by appropriate choice of the length $l_m$ of the magnetic strips, and of the thickness $t_i$ of the dielectric layer between the elongate conductor and the magnetic strips.

In preferred embodiments the thickness of the magnetic strips is selected to be less than the skin depth at $f_o$ in the magnetic material, and the thickness of the elongate conductor is preferably also less than the skin depth in the conductor, whereby loss is reduced. It will be understood that the elongate conductor and/or the magnetic strips can be multilayer structures, with each conductive layer being of thickness less than the skin depth in the material, and with dielectric material between adjacent conductive layers.

The magnetic material desirably is an amorphous Fe, Co, or Fe and Co-based ferromagnetic material with relatively high resistivity (exemplarily>30 $\mu\Omega$.cm), and with permeability $\mu$ selected such that the ferromagnetic resonance frequency of the material is greater than $f_o$. In another preferred embodiment the magnetic material is a nanocrystalline (average crystal size$\leqq$10 nm) ferromagnetic alloy, exemplarily of composition $Fe_{0.878}Cr_{0.046}Ta_{0.002}N_{0.074}$. Such alloys can have high magnetization, high permeability, low magnetostriction, and relatively low conductivity.

The dielectric material exemplarily is AlN, $SiO_x$ ($x\leqq 2$) or $Al_2O_3$, and the elongate conductor exemplarily comprises Cu, Al, Ag or Au.

DETAILED DESCRIPTION

In the course of a theoretical investigation of planar inductive elements for RF applications, we made the discovery that, by means of relatively simple changes, inductive elements with significantly improved characteristics can be obtained.

Figure 1:
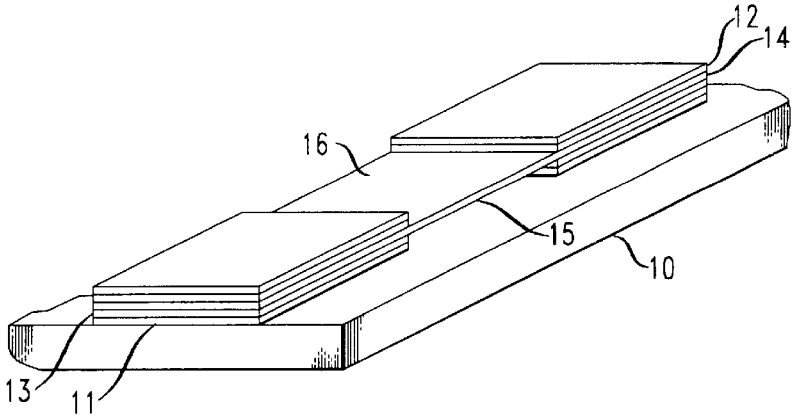
FIGS. 1 and 2 schematically depict a portion of an exemplary inductive element according to the invention with and without air gap, respectively.

FIG. 1 schematically shows in perspective view a portion of an exemplary inductive element according to the invention, wherein numeral 10 refers to a substrate (e.g., Si), numerals 11 and 12 respectively refer to the lower and upper magnetic strip, numerals 13 and 14 respectively refer to the lower and upper dielectric layer (e.g., $SiO_2$), numeral 15 refers to the elongate conductor, and numeral 16 refers to the spacing between adjacent magnetic strips.

As is readily evident, the structure of FIG. 1 does not provide for closed flux paths in magnetic material if current flows in the elongate conductor, due to the gap between corresponding upper and lower magnetic strips. Consequently, the structure of FIG. 1 (to be referred to as an "air gap" structure) can generally not attain as high inductance as an analogous gap-free structure, and is generally not preferred. On the other hand, the air gap structure is easy to make, and may at times be used for that reason.

Figure 2:
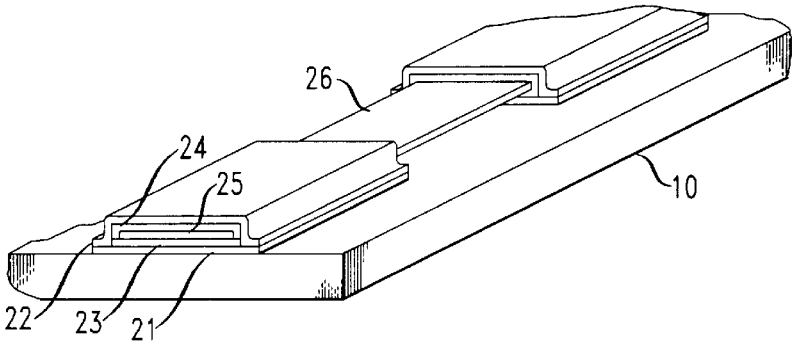

FIG. 2 schematically depicts in perspective view a portion of an exemplary inductive element that provides a closed flux path in the magnetic material. Numerals 21 and 22 respectively refer to the lower and upper magnetic strip. Numerals 23 and 24 respectively refer to the lower and upper dielectric layers, and numeral 25 refers to the elongate conductor. Numeral 26 refers to the spacing between adjacent magnetic strips.

The structures of FIGS. 1 and 2 represent the limits of a more general structure having an air gap that is less than or equal to the vertical distance between the upper and lower magnetic strips.

Figure 3:
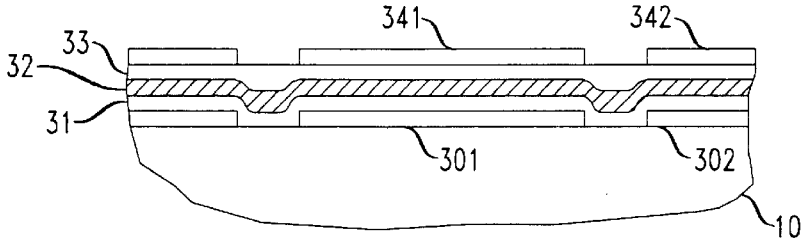
FIG. 3 schematically shows a portion of an exemplary inductive element according to the invention in sectioned side view.

In practice the elongate conductor will typically not be suspended in the gap between adjacent magnetic strips, as is shown in FIGS. 1 and 2 for the sake of clarity. Instead, the elongate conductor typically will not be perfectly planar but will follow the changes in elevation, as is illustrated by FIG. 3, which schematically shows a portion of an inductive element according to the invention in sectioned side view. Numeral 301 and 302 refer to adjacent lower magnetic strips, numerals 31 and 33 refer to the dielectric layers, numeral 32 refers to the elongate conductor, and numerals 341 and 342 refer to adjacent upper magnetic strips. FIG. 3 can represent an air gap structure or be a gapless structure.

It is an experimental fact that currently there are no high resistivity magnetic materials that can be deposited in thin film form and that are useful at frequencies of interest herein, exemplarily 0.1–2 GHz. Thus, the magnetic material of the lower and upper magnetic strips typically will be metallic material (e.g., $Ni_{0.8}Fe_{0.2}$, amorphous $Co_{0.86}Nb_{0.09}Zr_{0.05}$ or "CNZ"), since these materials can be deposited in thin film form at low temperature on most relevant surfaces, with the deposit having a thickness typically in the range 0.1–2 $\mu$m, and an in-plane magnetic anisotropy field typically in the range 10–100 Oe. The anisotropy field is a desirable feature since it generally will keep the ferromagnetic resonance frequency above the desired operating frequency. The thin magnetic films then have a permeability $\mu$ due to coherent rotation of the spins (as opposed to domain wall motion) in the range 100–1000. Desirably the resistivity of the magnetic films is as large as possible. By way of example, the resistivity of CNZ in amorphous thin film form is about 100 $\mu\Omega$.cm, about 50 times the resistivity of copper.

The structures of FIGS. 1 and 2 comprise a conductor in close proximity to the conductive magnetic strips, with dielectric material therebetween. Under DC conditions, essentially no current will flow between the conductor and the magnetic strips. However, the structure provides distributed capacitance, and under AC conditions displacement current flows between the conductor and the magnetic strips. Any current that flows in the magnetic strips, being detrimental, the distributed capacitance desirably is kept small by choice of relatively thick dielectric layers. On the other hand, relatively thick dielectric layers (e.g., $\leqq 2\,\mu$m) are difficult to deposit, and decrease the magnetic efficiency of the structure. Thus, the thickness $t_i$ of the dielectric layers will typically be a compromise between these conflicting requirements, with $0.5\ \mu m \leqq t_i \leqq 2\ \mu m$ frequently being a useful range.

Our theoretical analysis has shown that, for an inductive element of the type shown in FIG. 2 the frequency $f_{RC}$ at which capacitive coupling between the elongate conductor and the magnetic strips becomes a significant factor is $$f_{RC}=(t_m t_i \sigma_m)/(2\pi \in l_m^2), \qquad \text{Equ.1}$$

where $t_m$ is the magnetic strip thickness;

$t_i$ is the dielectric layer thickness;

$\sigma_m$ is the magnetic strip conductivity;

$\in$ is the dielectric constant of the dielectric; and $l_m$ is the length of the magnetic strips, as defined above.

Typically it will be desirable that $f_{RC}$ is greater than the operating frequency $f_o$. Thus, for a desired value of $f_o$, and for given values of $t_m$, $\sigma_m$, and $\in$, the parameters $l_m$ and $t_i$ are selected such that $$l_m<(t_m t_i \sigma_m/2\pi \in f_o)^{1/2}. \qquad \text{Equ.2}$$

Our theoretical analysis revealed a further condition to be met, namely $$l_m<\tfrac{1}{2}\pi f_o(\mu \in t_m/t_i)^{e,fra\ 1/2}, \qquad \text{Equ.3}$$

where $\mu$ is the permeability of the magnetic strips, and all other symbols are as defined above.

In practice, the designer typically will determine the upper limit of $l_m$ according to equations 2 and 3, and will choose $l_m$ and $t_i$ according to the smaller of the values.

The above equations are derived for linear inductive elements without air gap, substantially as shown in FIG. 2. The derivation can be extended to other structures, but the considerations will be similar. That is to say, in inductive elements according to our invention it is a general design criterion that the length of the magnetic strips and the thickness of the dielectric layers are selected such that, at a desired operating frequency $f_o$, the current in the magnetic strips is a relatively small fraction of the total current. If, for instance, the current in the magnetic strips is 10% of the total current, then the inductance of the structure will be reduced by only about 5%. However, for many applications it is necessary that the inductive element has low loss. For instance, if the conductivity of the magnetic strips is only 2% of the conductivity of the elongate conductor (as is the case if the former is amorphous metal magnetic material such as CNZ and the latter is copper), then the loss in the structure will be primarily due to the (relatively small) current in the magnetic strips, and the inductive element will have significant loss and therefore a relatively low quality factor. This is clearly undesirable, and it will be desirable to select $l_m$ and $t_i$ such that at $f_o$ the current in the magnetic strips is acceptably low to provide a low loss. Typically the current in the magnetic strips at $f_o$ is at most 10% of the total current.

By way of example, if $t_m=t_i=t_c=1\ \mu$m, $\sigma m=10^4$ S/cm, the dielectric is $SiO_2$, with $\in$ about $35\cdot10^{-14}$ F/cm, $\mu$=500 and $f_o$=2 GHz., then equ. 2 yields $l_m$<2.1 mm, and equ. 3 yields $l_m$<1.1 mm. Thus, the inductive element should be designed with $l_m$<1.1 mm, e.g., $l_m$=0.5 mm.

It will be understood that $l_m$ will always be greater than zero, exemplarily and preferably≧50 μm. The gap between adjacent magnetic strips will generally be less than $l_m$, desirably less than 0.25 $l_m$ or even 0.1 $l_m$, in order to maximize the attainable inductance. Typically, but not necessarily, all members of the multiplicity of magnetic strips of a given inductive element have the same length $l_m$, and all gaps between adjacent magnetic strips have the same length.

The basic structure of the inductive element according to the invention is a linear one, and use of linear inductive elements according to the invention is contemplated. However, the invention is not necessarily embodied in linear structures but can take any desired form, e.g., a meander pattern or a spiral. All such embodiments will benefit from the relatively high self-inductance of the basic structure.

Inductive elements according to the invention exemplarily are provided on IC chips for use in, e.g., wireless communication apparatus. Aside from the presence of the inductive element according to the invention on the IC chip, the apparatus can be conventional.

Figure 4:
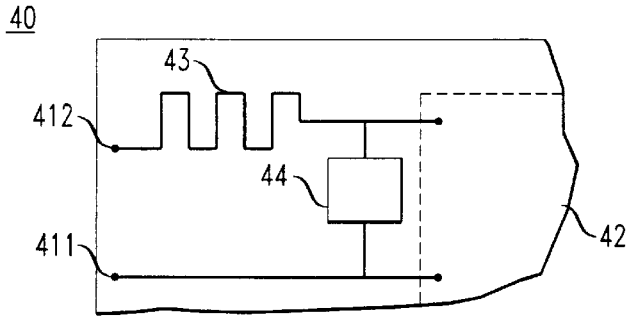
FIG. 4 schematically depicts an exemplary article according to the invention, namely, an IC with integrated inductive element.

It will be understood that inductive elements according to the invention can be produced by conventional thin film deposition techniques, lithography and etching. For instance, the magnetic and conductor layers can be deposited by sputtering, and the dielectric layers can be deposited by chemical vapor deposition or evaporation. Standard photolithography can be used to delineate the patterns and the layers can be patterned by means of reactive ion etching FIG. 4 schematically shows a relevant portion of an article according to the invention, exemplarily an IC chip 40 for use in wireless communication apparatus. Numeral 42 refers to a region of the chip that contains conventional integrated circuitry (not shown). Numerals 43 and 44 refer to an inductive element according to the invention in meander form and a capacitor, respectively, with inductive element and capacitor connected to provide a filter function. Numerals 411 and 412 refer to conventional contacts.

EXAMPLE

A linear inductor according to the invention is made as follows. A conventional Si wafer is coated with a 600 nm thick $SiO_2$ layer by conventional thermal oxidation. This is followed by sputter deposition (room temperature, 5 mTorr pressure, 10 Oe magnetic field applied in the plane of the substrate) of a 1 μm thick layer of $Co_{0.85}Nb_{0.09}Zr_{0.06}$ (CNZ). The direction of the applied magnetic field establishes an "easy axis" in the CNZ layer. The CNZ layer is then patterned into a line of 16 rectangles (each rectangle being 0.5 mm×35 μm), separated by 50 μm. Patterning is in conventional fashion, using photolithography and ion beam etching (500 V beam voltage, beam current density 2 mA/cm$^2$, 3 hours). The about 8.8 mm long line of rectangles is aligned with the "easy axis" of the CNZ layer. The rectangles are destined to become the conductive lower magnetic strips, corresponding, e.g., to feature 21 of FIG. 2 herein. Subsequently, a 1 μm thick layer of $SiO_2$ is deposited (250° C., using a commercially available Plasma CVD apparatus), and the $SiO_2$ layer is patterned, using a conventional wet etch, into a 8.75 mm×30 μm rectangle that is centered on the line of CNZ rectangles. This is followed by sputter deposition (room temperature, 5 mTorr pressure) of a 1 μm thick copper layer. Using photolithography and a conventional chemical etch, the copper layer is patterned into a line that is 25 μm wide and 8.7 mm long (plus a contact pad at each end), centered on the previously formed $SiO_2$ rectangle. This is followed by deposition of a 1 μm thick layer of $SiO_2$ (250° C., using commercial Plasma CVD apparatus). This $SiO_2$ layer is then patterned by conventional chemical etching into a rectangle (8.75 mm×30 μm) that is centered on the line of CNZ rectangles. This is followed by deposition of a 1 μm thick film of CNZ by sputtering (room temperature, 5 mTorr pressure), with a 10 Oe magnetic field applied in the plane of the substrate, in the direction along the line of CNZ rectangles. This CNZ film is then patterned into a line of rectangles (0.5 mm×35 μm, separated by 50 μm) by means of photolithography and ion beam etching (500 V beam voltage, 2 mA/cm$^2$ beam current density, 3 hours). These rectangles form the conductive upper magnetic strips (corresponding, e.g, to feature 22 of FIG. 2 herein). This completes formation of a linear inductor without air gap, with $t_m=t_i=t_c=1$ μm, with $l_m$=0.5 mm, and with 50 μm spacing between adjacent magnetic strips.

The thus produced inductor according to the invention, with relative permeability $\mu_r$=500 of the CNZ, with relative dielectric constant $\in_r$=4 of the $SiO_2$, and with conductor width 25 μm, has calculated total conductance 106 nH, total impedance $Z_T$=(16+i667)Ω, and quality factor Q=40, all at 1 GHz. The values were calculated using a lumped RLC series/parallel equivalent circuit.

A prior art comparison inductor, differing from the exemplary inductor only with regard to segmentation (i.e., the conductive magnetic strip is continuous over the length of the inductor), has calculated total inductance 32 nH, $Z_T$=(76+i202)Ω, and Q=2.6, all at 1 GHz.

A further prior art inductor, differing from the above described inductor according to the invention by having no segmentation and by having no insulation (i.e., $t_i$=0), has total inductance 35 nH, $Z_T$=(69+i222)Ω, and Q=3.2, all at 1 GHz.

The above data clearly demonstrate the improved characteristics of inductors according to the invention, as compared to unsegmented prior art conductors.

The invention claimed is:

1. An article comprising a substrate having a major surface, with a thin film inductive element thereon, the inductive element comprising an elongate conductor, a multiplicity of spaced apart conductive lower magnetic strips of length $l_m$ disposed on the major surface, and a corresponding multiplicity of spaced apart conductive upper magnetic strips of length $l_m$, with the elongate conductor disposed between the lower and upper magnetic strips;

CHARACTERIZED IN THAT the inductive element further comprises dielectric material of thickness $t_i$ disposed between the spaced apart lower magnetic strips and the elongate conductor, and between the elongate conductor and the spaced apart upper magnetic strips.

2. Article according to claim 1, wherein $t_i$ is selected such that $$l_m<(t_m t_i \sigma_m/2\pi\in f_o)^{1/2}$$

and $$l_m<\tfrac{1}{2}\pi f_o(\mu\in t_m/t_i)^{1/2},$$

where $t_m$ is the thickness of the magnetic strips, σm is the electrical conductivity of the magnetic strips, ∈ is the dielectric constant of the dielectric material, $f_o$ is a predetermined operating frequency, and $\mu$ is the permeability of the magnetic strips.

3. Article according to claim 1, wherein $f_o$ is in the range 0.1–2.0 GHz, where $f_o$ is a predetermined operating frequency.

4. Article according to claim 1, wherein at least one of the magnetic strips comprises two or more layers of magnetic material, with a dielectric layer between adjacent layers of magnetic material.

5. Article according to claim 1, wherein the thickness of the elongate conductor is at $f_o$, less than a skin depth of the elongate conductor.

6. Article according to claim 1, wherein the thickness of the magnetic strips is at $f_o$, less than a skin depth of the magnetic strips.

7. Article according to claim 1, wherein $l_m$>50 $\mu$m, and wherein a spacing between adjacent magnetic strips is less than $l_m$.

8. Article according to claim 7, wherein the spacing between adjacent magnetic strips is less than 0.25 $l_m$.

9. Article according to claim 1, wherein the magnetic strips have resistivity greater than 30 $\mu\Omega$.cm.

10. Article according to claim 1, wherein the inductive element has a meander shape.

11. Article according to claim 1, wherein the substrate is a Si body, with integrated electronic circuitry on the body, and with the inductive element connected to the circuitry.

* * * * *